US009854881B1

(12) United States Patent
Salaskar

(10) Patent No.: US 9,854,881 B1
(45) Date of Patent: Jan. 2, 2018

(54) APPARATUS TO FACILITATE INTERCHANGEABLE JEWELRY HEAD HAVING TWO FEET AND A COIL SPRING RETENTION MECHANISM WITH PUSHBUTTON RELEASE MEMBER

(71) Applicant: Mahesh Sahdev Salaskar, Mumbai (IN)

(72) Inventor: Mahesh Sahdev Salaskar, Mumbai (IN)

(73) Assignee: Jewelex New York, Ltd., New York, NY (US)

( * ) Notice: Subject to any disclaimer, the term of this patent is extended or adjusted under 35 U.S.C. 154(b) by 278 days.

(21) Appl. No.: 14/704,413

(22) Filed: May 5, 2015

(51) Int. Cl.
*A44C 17/02* (2006.01)

(52) U.S. Cl.
CPC ..... *A44C 17/0225* (2013.01)

(58) Field of Classification Search
CPC ..... A44C 9/00; A44C 17/0216; A44C 13/00; A44C 9/0053; A44C 9/0061; A44C 15/00; A44C 15/0025; A44C 15/0095; A44C 17/0208; A44C 17/0225; A44C 17/02; A44C 17/0241
USPC ..... 63/29.1, 40
See application file for complete search history.

(56) References Cited

U.S. PATENT DOCUMENTS

| | | | | | |
|---|---|---|---|---|---|
| 685,044 | A * | 10/1901 | Haussmann | A44C 17/0208 | 63/29.1 |
| 700,637 | A * | 5/1902 | Frey, Jr. | A44C 17/0208 | 63/29.1 |
| 792,334 | A * | 6/1905 | Levy | A44C 17/0208 | 63/29.1 |
| 1,911,935 | A * | 5/1933 | Vidal | A44C 7/003 | 24/110 |
| 2,530,432 | A * | 11/1950 | Imowicz | A44C 17/0208 | 63/29.1 |
| 5,491,986 | A * | 2/1996 | White | A44C 11/005 | 24/115 G |
| 6,389,662 | B1 * | 5/2002 | Hamm, Jr. | A44C 7/003 | 24/705 |

FOREIGN PATENT DOCUMENTS

| | | |
|---|---|---|
| CN | 2075732 | 2/1993 |
| CN | 2185383 | 3/1997 |
| GB | 192816863 | 7/1929 |

* cited by examiner

*Primary Examiner* — Jack W Lavinder
(74) *Attorney, Agent, or Firm* — Thomas I. Rozsa

(57) ABSTRACT

An apparatus which facilitates an interchangeable look of an item of jewelry by a new process to be able to vary and/or change the complete outlook of a jewelry product; for example by changing the head of a shank to form a new jewelry ring every time the head changes with the help of the innovative mechanism of the present invention. The invention is comprised of a combination of an innovative process, composition of matter and combination device giving infinite options to change an appearance of an item jewelry.

2 Claims, 13 Drawing Sheets

APPARATUS TO FACILITATE INTERCHANGEABLE JEWELRY HEAD HAVING TWO FEET AND A COIL SPRING RETENTION MECHANISM WITH PUSHBUTTON RELEASE MEMBER

CROSS-REFERENCE TO RELATED APPLICATION

This patent application claims priority to Provisional Application No. 61/989,422 filed on May 6, 2014.

BACKGROUND OF THE INVENTION

1. Field of the Invention

This invention relates to the field of jewelry, i.e. rings, earrings, pendants, bracelets, etc or any form or style article of manufacture commonly known as "jewelry". Jewelry is also defined as decorative objects that people wear their body. The present invention also relates to the field of modifying the appearance of a jewelry item by facilitating interchangeable parts on the item of jewelry.

2. Description of the Prior Art

At the time of filing this provisional patent application, the inventor of the present jewelry invention is aware of the following relevant prior art patents:

1. Great Britain Patent GB192816863A is directed to improvements in jewelry. This patent discloses a piece of jewelry composed of several elements in which a mounting carrying a stone or jewel is connected to one or the several elements by resilient clips in such a manner that these elements can be easily interchanged to alter the effect of the piece of the jewelry.

2. Australia Patent Publication 199918678D discloses different types of jewelry such as rings, pendents, necklaces, belt buckles, brooches, (clock) bracelets or the like, with a removable gemstone body or an imitation of such or a design element consisting of a main body, the gemstone body and/or the design element receiving attachment.

3. Canadian Patent 2185383A discloses having a jewelry item such as an earring which includes a mounting assembly to releasably engage an individual to a desired body location and including hypo allergenic material on surfaces contacting the individual. The ornamental element releasably attachable to said mounting assembly and a spacer to space the ornamental element from the individual when said ornamental element is attached to the mounting assembly is disclosed.

4. Canadian Patent 2075732 discloses an improved jewelry mounting construction capable of being adapted for use selectively for either pierced or non-pierced ears. The improved construction comprises a base which is attached to the decorative portion of an earring and is compatible with interchangeable fasteners. The base and the fasteners have complementary connections which releasably connect the fasteners to the base. The base comprises a first layer affixed to a fashion, and a second layer attached to the first layer, defining a notch. The fastener includes a plate. The two layers of the base are attached to the plate of the fastener which can slide in between and be caught firmly.

5. Australian Patent Publication 2008201420A discloses a fastener for portion includes a shank to which a visual feature is attached. The shank includes first and second portions wherein the second portion has a width or diameter larger than the width or diameter of the first portion. The shank is positioned against the fabric and the fastening means is held against the shank on the other side of the fabric.

6. United States Patent Publication 1983477153A relates to a ring or article of decorative jewelry that has multiple interchangeable decorative stones. The ring is made with a flexible hinged top piece securing large polished stones against a bezel rising from the ring. The stones are securely gripped by the flexible spring action of the hinged lid and it is unnecessary for the stones themselves be placed in any sort of intermediate mounting.

There is still a need for an easy and convenient process of jewelry making so that it is possible to be able to vary and/or change the complete outlook of a jewelry product by interchanging the head from the mounting base, for example by changing the head of the shank, to form a new jewelry ring every time the head changes. The shank acts as a mounting base for the ring.

One embodiment for accomplishing this is to create a click interchangeable process for manufacturing jewelry wherein the same mounting base can be used for different heads.

SUMMARY OF THE INVENTION

The present invention is an apparatus which facilitates an interchangeable look of an item of jewelry by a new process to be able to vary and/or change the complete outlook of a jewelry product; for example by changing the head of a shank to form a new jewelry ring every time the head changes with the help of the innovative mechanism of the present invention. The invention is comprised of a combination of an innovative process, composition of matter and combination device giving infinite options to change an appearance of an item jewelry.

The mechanism has been created with the help of various internal components and combinations that have been made and put together.

For Example: in the images below, the same shank has been used for all of the heads. The heads can be interchanged with other head options with the help of the unique mechanism created through the present invention. The intention of the patent application for the present invention is to protect the technique, parts and the mechanism created for a first embodiment the jewelry item which is hereafter sometimes referred to as a "Click Interchangeable Concept." The use of the Click Interchangeable Concept is not just limited to rings but to any form of jewelry such as necklaces, earrings, bracelets, pendants and any other unforeseen form of jewelry that may be created or imagined by the present inventor or a creation where this concept can be adapted.

It is an object of the present invention to provide an apparatus which changes the complete outward appearance of a jewelry product, for example by changing the head of a mounting base retained in the jewelry item where the same mounting base configuration is used to retain an interchangeable head member. The internal configuration of the jewelry item facilitates retention of a specific locking part having two feet with a gap within each foot into which a retention member within the jewelry item is located. The mounting base can be connected to an infinite variety of jewel head designs. When a separate head with the two feet is retained within the jewelry item, the exterior visual appearance of the jewelry item is materially changed.

For purposes of this provisional application the variation of click interchangeable concept disclosed and claimed involves a locking part with two spaced apart legs with retaining sections which receive a spring activated retaining member and a spring mechanism which requires a push button to release the shank from the retaining mechanism so that the exterior member affixed to the mounting base can be released when the mounting base is released.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
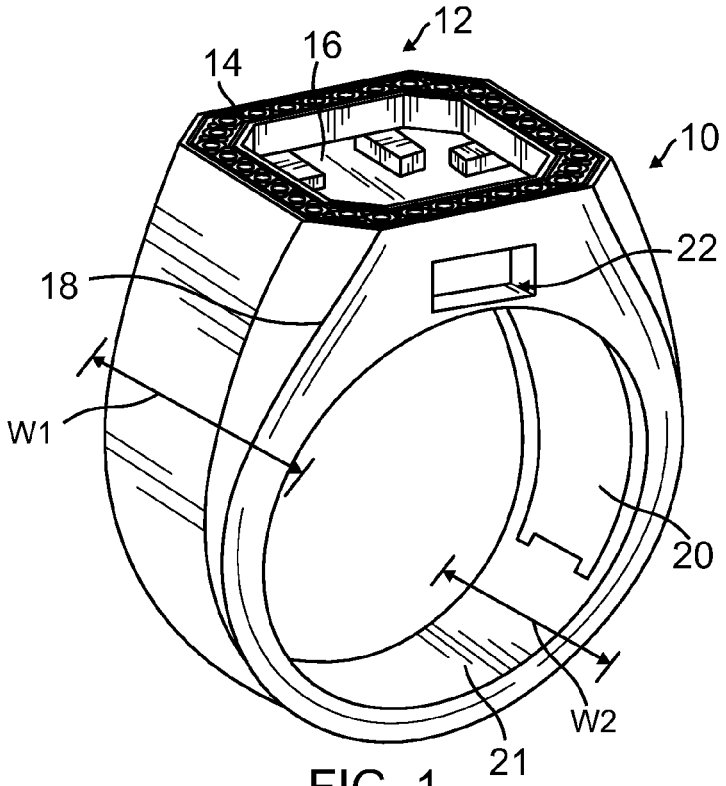
FIG. 1 is a perspective view of one embodiment of a shank of the present invention including a top surface surrounded by a circumferential bezel and a central opening through which ornamental heads are inserted and retained within the shank. The shank also creates a sidewall having a push clip hole extending through the entire width of the sidewall and also has an interior sidewall which has a J-back receiving member within it.
Figure 1A:
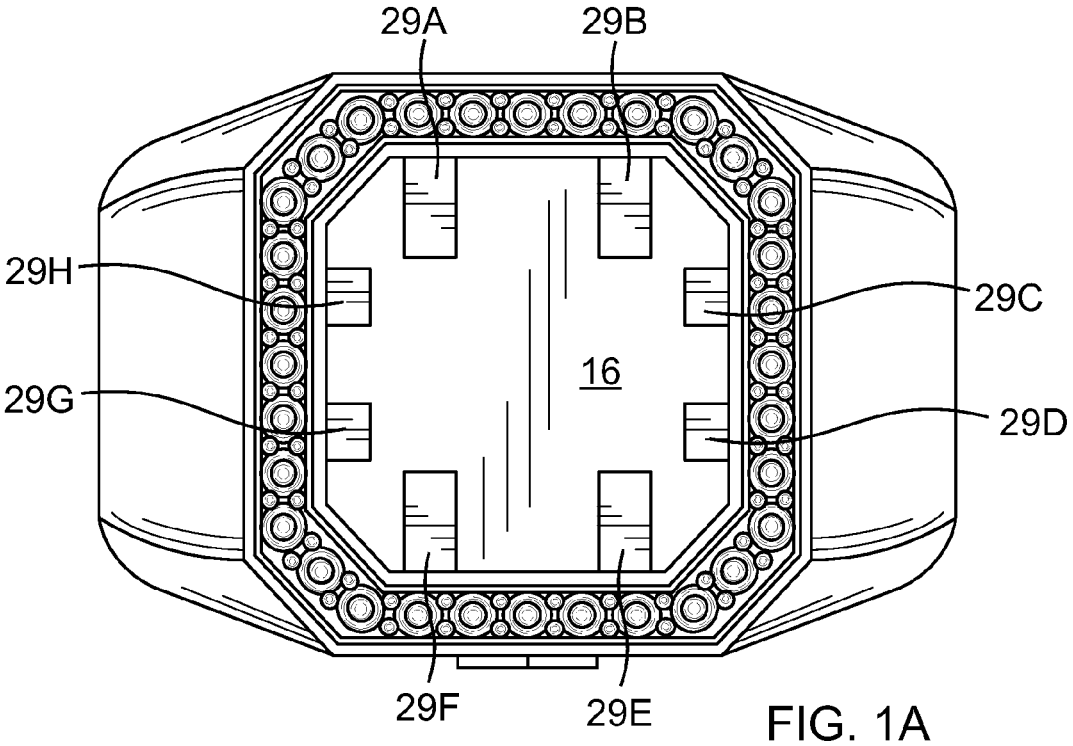
FIG. 1A is a top plan view of the shank illustrated in FIG. 1 better illustrating the locator pin around the opening.

Referring to FIG. 1, there is illustrated a side perspective view of an embodiment of a shank 10 having a top surface 12 surrounded by a circumferential bezel 14 and a central opening 16 through which ornamental heads such as 30A, 30B, 30C, 30D, 30E and 30F illustrated in FIGS. 4A, 4C, 5A, 5C, 6A, 6C are retained by a locking part. Referring to FIG. 1A, locator pins such as 29A, 29B, 29C, 29D, 29E, 29F, 29G and 29H which are located around opening 16 are optional but assist in placement of the pair of legs from the locking part. An upper surface of the locking part is affixed to a bottom surface of an ornamental head. The legs extend through the opening 16. The shank 10 has an exterior sidewall 18 and a push clip hole 22 extending through the entire exterior transverse exterior width W1 on the shank 10. The shank also has an internal sidewall 21 with an interior J-back receiving member 20 within interior sidewall 21. While only one is shown, it will be appreciated that there is an oppositely disposed J-back receiving member within the interior sidewall 21.

Figure 2:
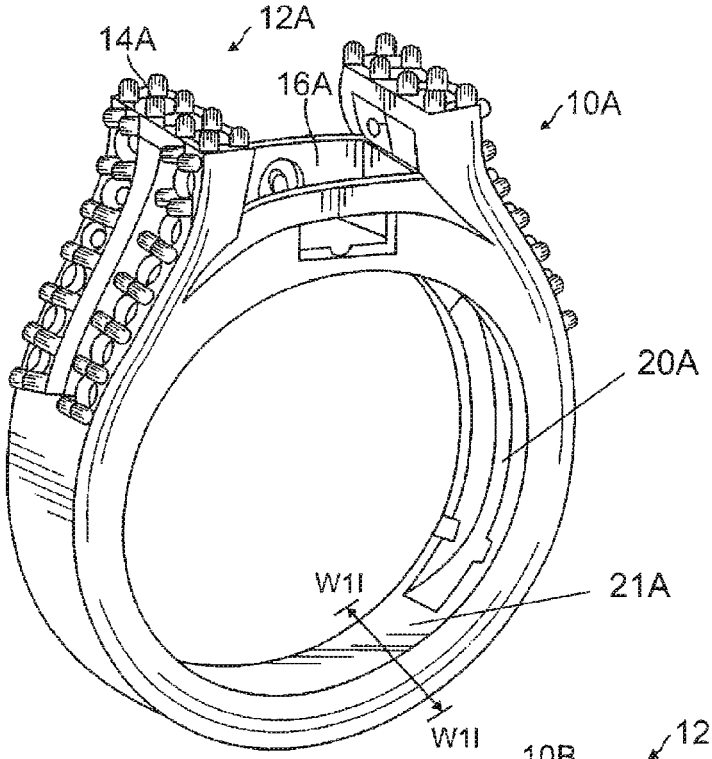
FIG. 2 is an alternative variation of the shank illustrated in FIG. 1 illustrating different variations on all the components illustrated in FIG. 1.
Figure 3:
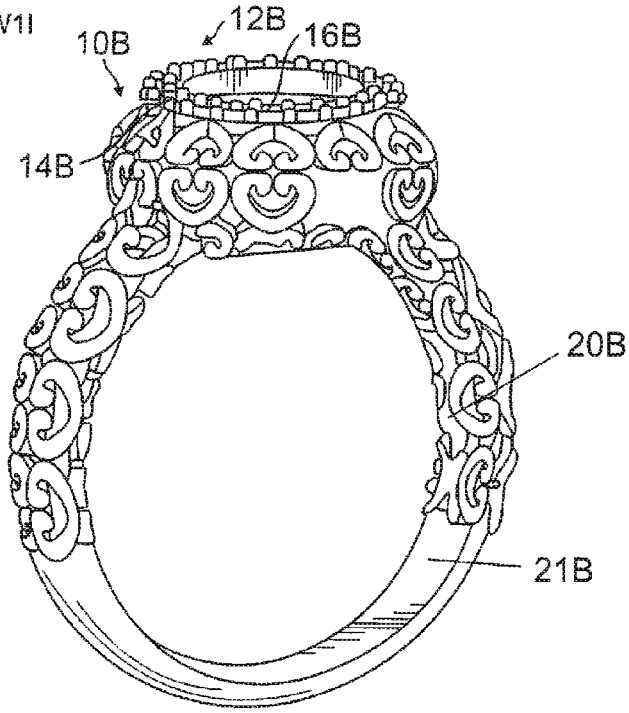
FIG. 3 is an alternative variation of the shank illustrated in FIG. 1, illustrating further variations on all of the components.

FIGS. 2 and 3 show some alternative embodiments for the shank 10A and 10B having a different shape. However the key components of the top surface 12A and 12B and a central opening 16A and 16B through which ornamental heads 30A, 30B, 30C, 30D, 30E and 30F are inserted, and a top circumferential ornament 14A and 14B. The shank 10A and 10B has an interior sidewall 21A and 21B with an interior J-back receiving member 20A and 20B extending within interior sidewall 21A and 21B through the entire transverse interior width "W2", FIG. 2 is an alternative variation of the shank illustrated in FIG. 1 illustrating different variations of all of the components illustrated in FIG. 1 with each of the same components numbered with the same number with an "A" after the number.

FIG. 3 is another alternative variation of the shank illustrated in FIG. 1 also illustrating variations on the components as illustrated in FIG. 1, the components having the same number but with the letter "B" after the number.

FIG. 1A is a more detailed top plan view of the shank illustrated in FIG. 1 illustrating optional locator pins numbered 29A, 29B, 29C, 29D, 29E, 29F, 29G and 29H which help and assist in positioning the core top over which the legs of the locking part which is affixed to the decorative head will be inserted as discussed below.

Figure 4A:
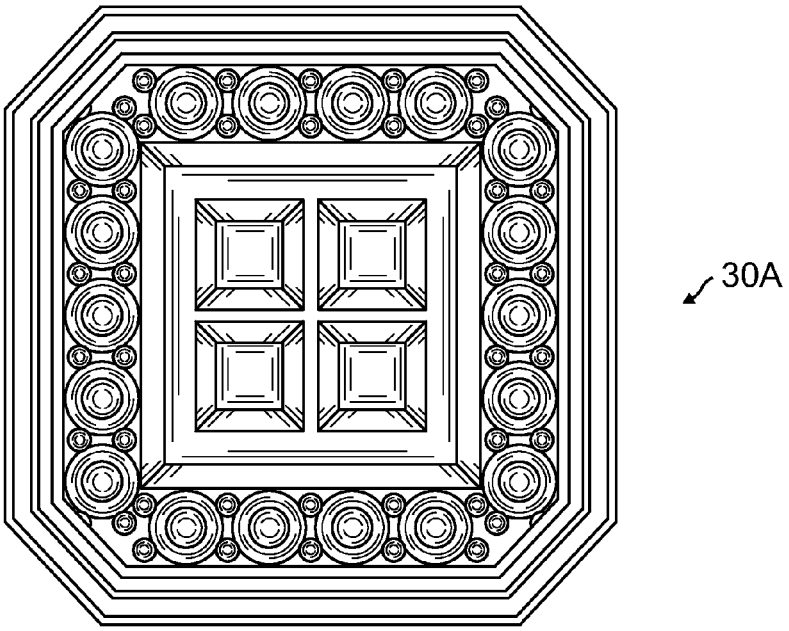
FIG. 4A is a top plan view of one embodiment of an ornamental head to be used with the present invention.
Figure 5A:
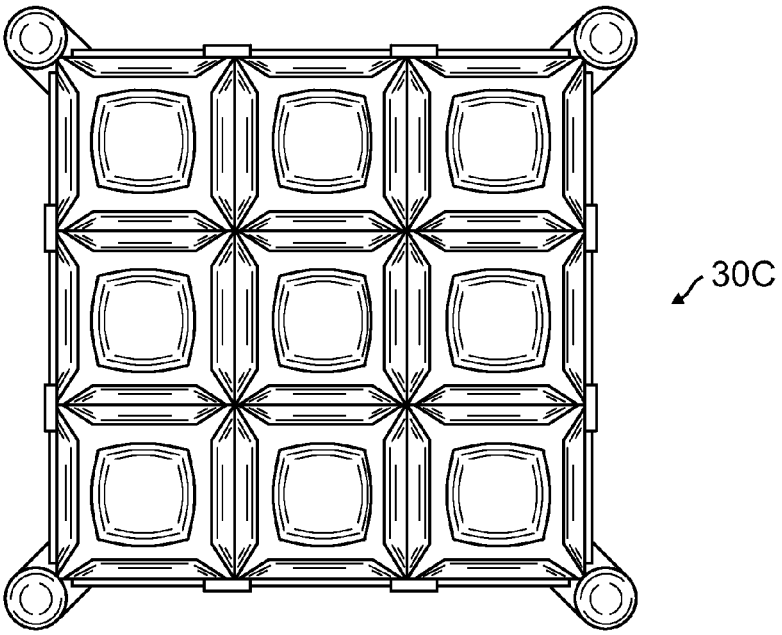
FIG. 5A is a top plan view of an alternative embodiment of an ornamental head used with the present invention.
Figure 6A:
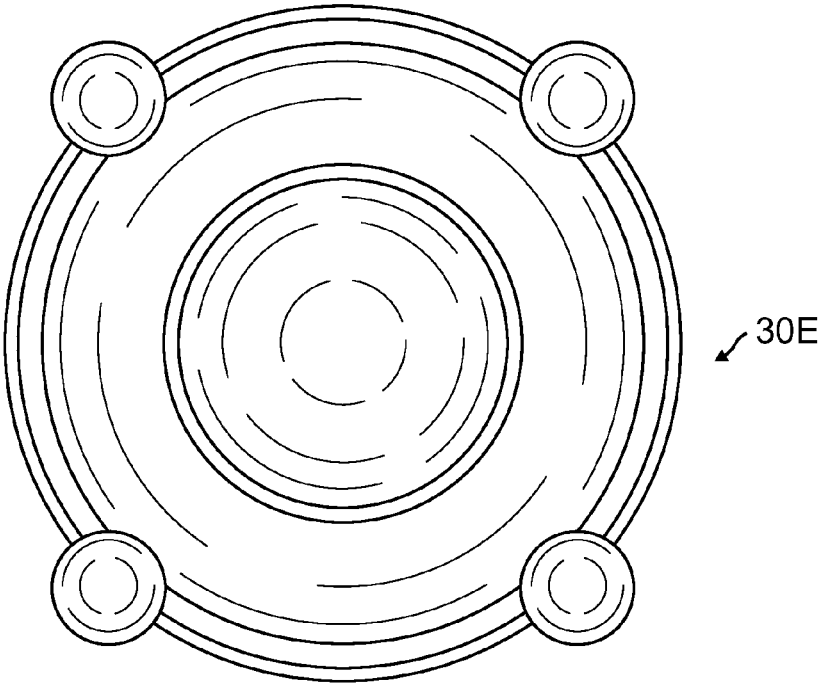
FIG. 6A is another alternative embodiment of the ornamental head to be used with the present invention.

FIGS. 4A, 5A and 6A show different types of alternative decorative heads that can be used with the present invention. In FIG. 4A, the decorative head numbered 30A has an attractive rectangular surface with princess cut diamonds in the middle. In FIG. 5A the decorative head numbered 30C has a multiplicity of nine stones set in square pattern. In FIG. 6A, the decorative head 6A is circular with four prongs set in offset positions approximately 90 degrees apart.

The heads and shanks can be of any shapes and sizes and not limited to what has been shown in the document.

Figure 4C:
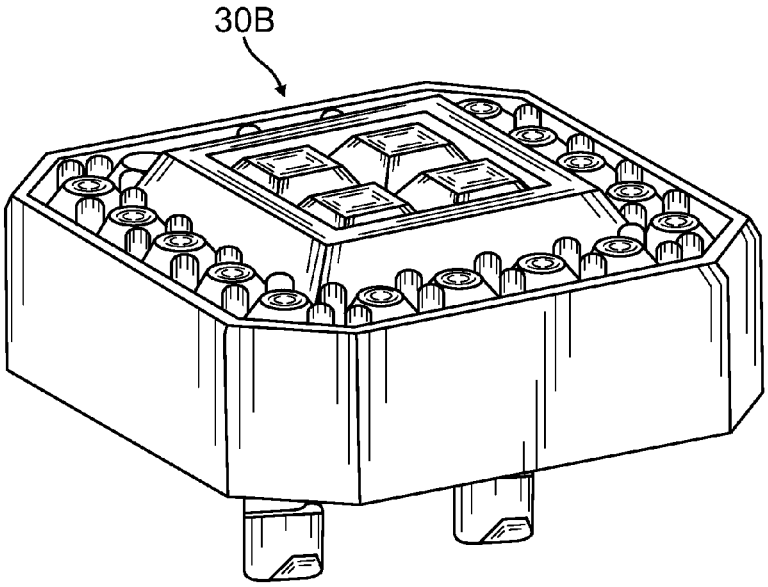
FIG. 4C is a perspective view of the ornamental head illustrated in FIG. 4A with the locking part affixed to the underside of the ornamental head.

The retaining mechanism for each of the stones may also be different. As illustrated in FIG. 4C, the retaining mechanism for the top stones having a circular bezel of stones with interior princess cut stones is retained in a base plate numbered 30B.

In the case of the design of FIG. 5A as is illustrated, the nine stones are retained by four arcuate prongs illustrated numbered 30D to designate all of the prongs so it is a different type of retaining mechanism.

Finally, with respect to the head on FIG. 6A, it retains a round stone with four prongs, each of which are generally designated as 30F to show how this stone is retained. The point is that the present invention can incorporate any multiplicity of different types of heads.

Figure 5C:
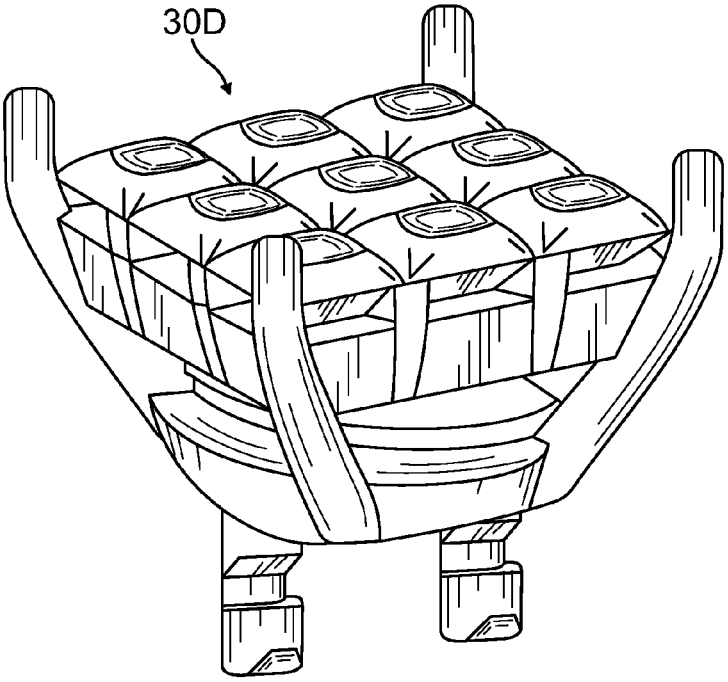
FIG. 5C is a perspective view of the ornamental head illustrated in FIG. 5A with a locking part attached to the bottom surface of the ornamental head.

The fundamental principle is that the lower surface of each head has a locking part which is a unique feature of the present invention and is described in detail in the following text. It will be appreciated that the locking part which is described as having a base affixed to a pair of spaced apart legs will have an upper surface of the base which is affixed to the lower surface of the head which is most common as shown in FIG. 4C. However, other affixation means by which the base of the locking member is affixed to the head are shown in FIG. 5C and also in FIG. 6C. It will be appreciated that these are only variations of numerous types of methods by which the locking part can be affixed to the head to have the different types of heads inserted into the opening 16 to give a totally different visual impression. The shape and size of the leg can also vary.

Figure 8:
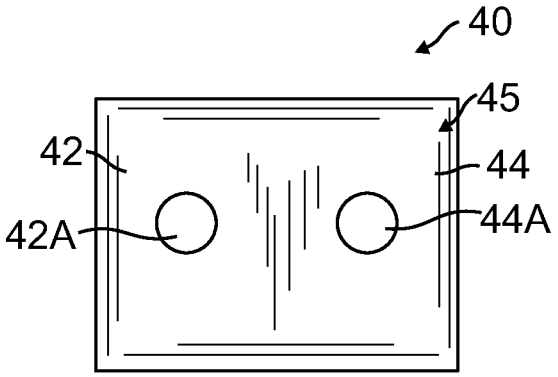
FIG. 8 is a top plan view of the core top of the present invention.
Figure 9:
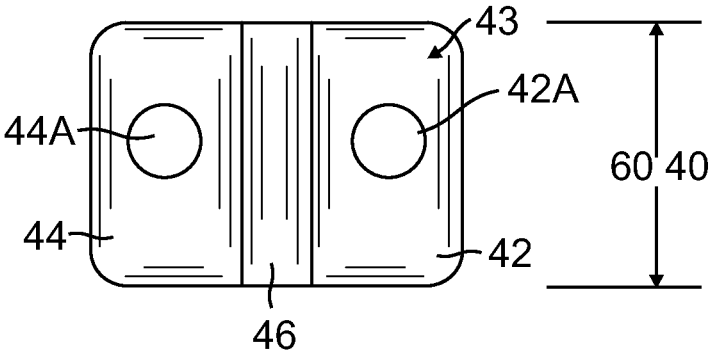
FIG. 9 is a core bottom of the present invention illustrating a central width wise channel.

Referring to FIG. 8, there is illustrated a core top 40 with a top surface 45 and which has a body part 42 with leg hole 42A and a body part 44 with leg hole 44A. Referring to FIG. 9, there is illustrated a core top 40 with bottom surface 43 with a central width-wise channel 46 running the entire width "W40" of the core bottom.

Figure 10:
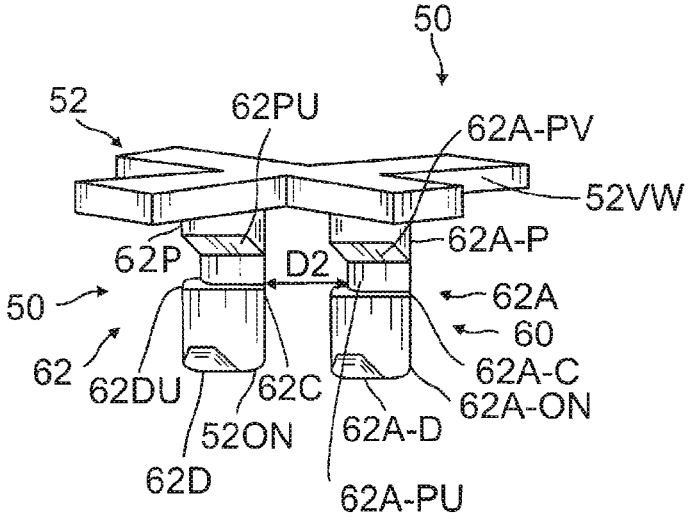
FIG. 10 is a perspective view of one embodiment of a locking part including a base and a pair of spaced apart feet, the base being the shape of a cross.
Figure 11:
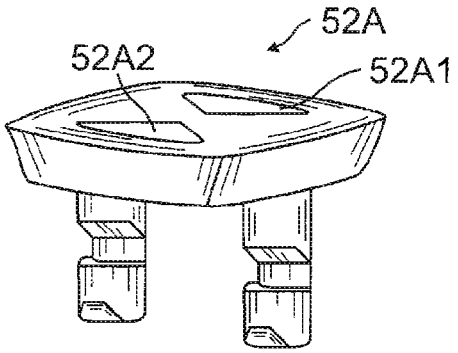
FIG. 11 is an alternative embodiment of the locking part used with the present invention including a pair of spaced apart feet affixed to a base having a horizontal surface and a pair of oppositely disposed openings.
Figure 12:
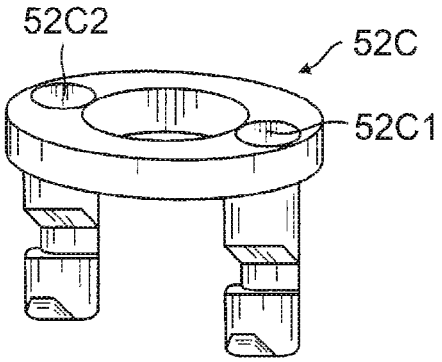
FIG. 12 is a second alternative embodiment of the locking part used with the present invention including a pair of spaced apart feet affixed to a base having a pair of feet openings and a central circular marking.

Referring to FIGS. 10, 11 and 12, a key component of the present invention is the locking part 50 with variations illustrated in FIGS. 10, 11 and 12. Referring specifically to FIG. 10, the locking part 50 has two major components, a base 52 and legs 60. The base 52 is sized and shaped to be affixed to or mounted to the underside of various shaped jewelry heads 30A as illustrated in FIG. 4C. Base 52 can be a cross (FIG. 10), a square 52A with openings 52A-1 and 52A-2 (FIG. 11) and round 52C with leg openings 52C-1 and 52C-2 (FIG. 12), The shape and size of the base may vary depending on the shape and size of the head.

Referring further to FIG. 10, the legs 60 comprise a first leg 62 with a proximal section 62-P affixed to an underside 52UN of a base 52, a distal section 62-D and a center concave section 62-C between the proximal section 62-P and the distal section 62-D. The distal section has a flat upper portion 62-DU adjacent concave section 62-C and the proximal section 62-P has a slanted lower surface 62-PU adjacent the concave section 62-C. The second leg 62A has the same components as the first leg 62 with the letter "A" after each corresponding number and are numbered 62A-P, 62A-D, 62A-C, 62A-DU, and 62A-PU. The proximal section 62A-P is also affixed to the underside 52UN of base 52. The legs 62 and 62A are spaced apart by a given distance "D2". Each component of leg 62 is aligned with a respective corresponding component of leg 62A. Specifically, proximal sections 62P and 62P-A are aligned. Slanted sections 62-PU and 62A-PU are aligned. Concave sections 62C and 62A-C are aligned. Distal section 62D and 62AD are aligned. The flat upper portion of distal section 62DU and 62A-DU are aligned. The alternative embodiments illustrated in FIGS. 11 and 12 have the same leg components.

Figure 6C:
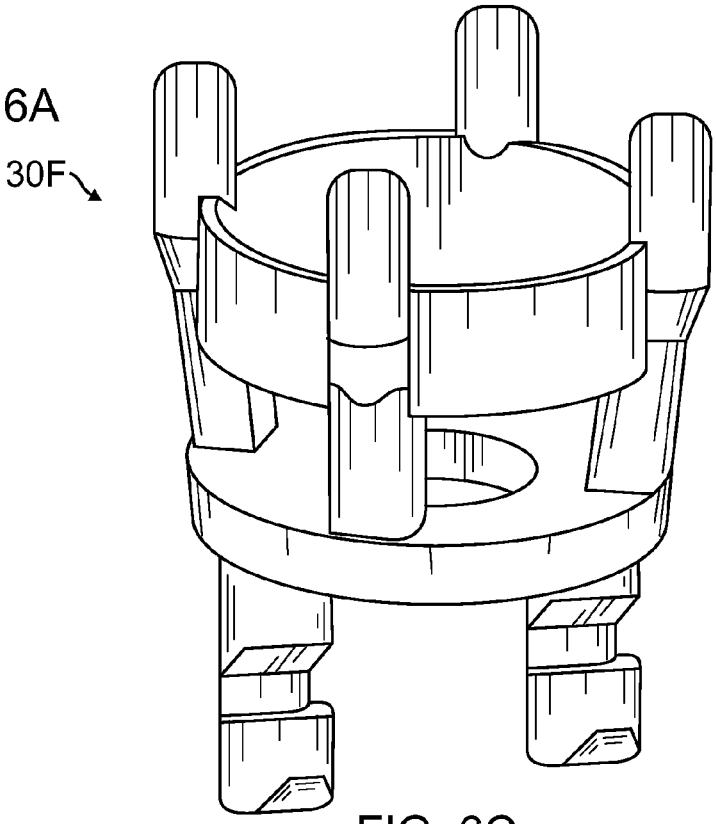
FIG. 6C shows the ornamental head affixed to a locking part.
Figure 7:
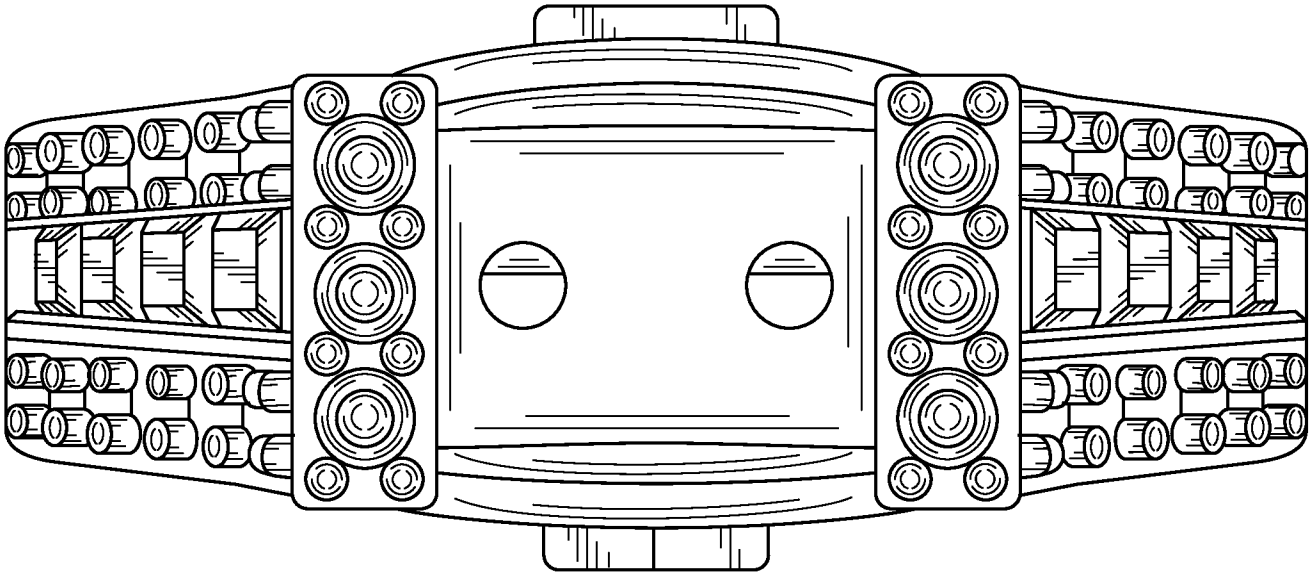
FIG. 7 is a top plan view of the core top fixed over the shank.

As illustrated in FIGS. 4C, 5C and 6C, the base 52 can be affixed to the head section 30A etc. in different manners depending upon the under surface of the attaching prongs of the head section. In the case of the first embodiment item 4C, the upper surface of the base 52 is attached to the lower surface of the head section. In the case of item 5C, the base essentially is encompassed in prongs which attach to the head. In the case of 6C, the base is further encompassed in prongs and also is set within prongs underneath the head. It will therefore be appreciated that the base 52 or any variations thereof such as 52A or 52B can be attached to the head section depending upon the configuration of the head section and its surface or prongs which retain the stones of the head section.

The dimensions of the legs 62 and 62A can be modified depending on the design requirement for a specific jewelry piece. The head which by way of example 30A, 30B, 30C, 30D, 30E and 30F is also a vital part of the design. When a head 30A (or variations) are interchanged, it will create a totally new design every time a new head 30A is placed on a shank 10 of a jewelry item.

Figure 13A:
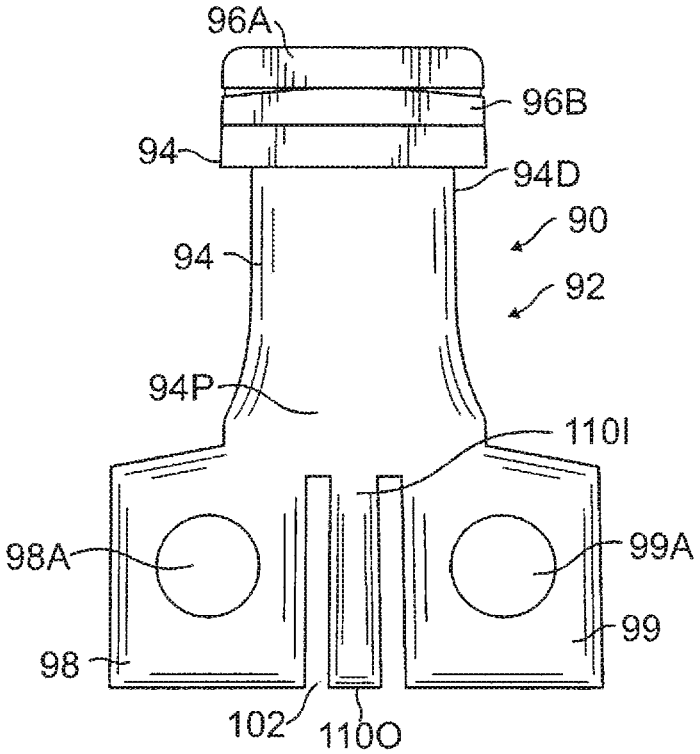
FIG. 13A is a top plan view of the push clip.
Figure 13B:
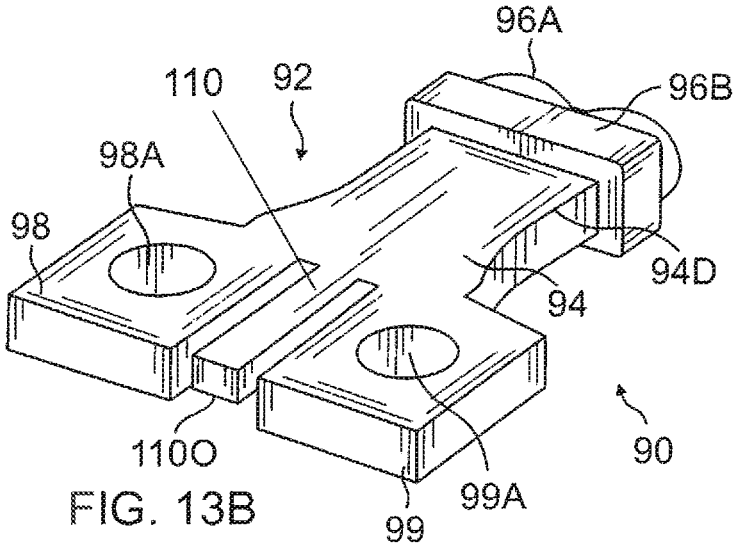
FIG. 13B is a top perspective view of the push clip.
Figure 14A:
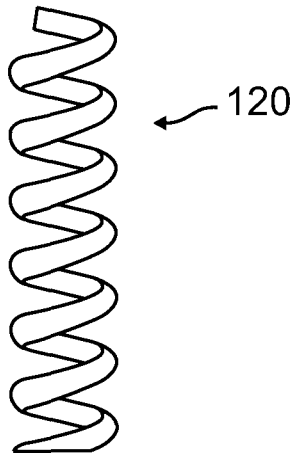
FIG. 14A is a side elevational view of the coil spring.
Figure 14B:
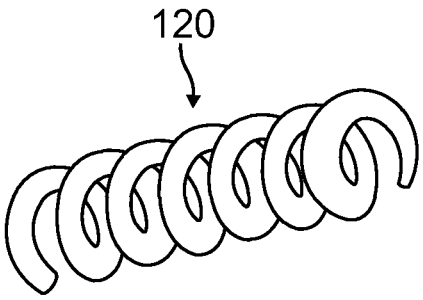
FIG. 14B is a side perspective view of the coil spring.
Figure 14C:
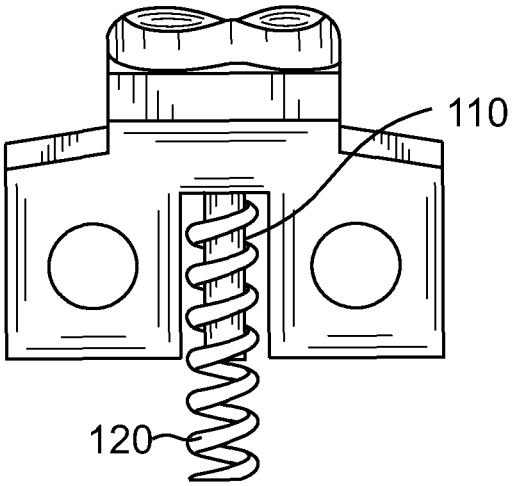
FIG. 14C is a top plan view of the coil spring mounted on the retaining rod of the push clip.

As illustrated in FIGS. 13A and 13B, push clip 90 includes a body 92 with a transverse shaft 94 terminating at its distal end 94D in a first button 96A and a second button 96B. The push clip 90 has a first leg 98 with a first left hole 98A respectively aligned with body part 42 with hole 42A of core top 40 and a second leg 99 with a second leg hole 99A aligned with body part 44 with hole 44A of core top 40. The first leg 98 and second leg 99 are separated by an opening 102 with a center rod 110 extending parallel to the legs 98 and 99 and affixed at its interior end 110I to the proximal end 94P of transverse shaft 94. The center rod 110 has an open end 1100. Referring to FIGS. 14A and 14B, a metal coil spring 120 is illustrated. As illustrated in FIG. 14C, the coil spring 120 is wound over the center rod 110.

Figure 15C:
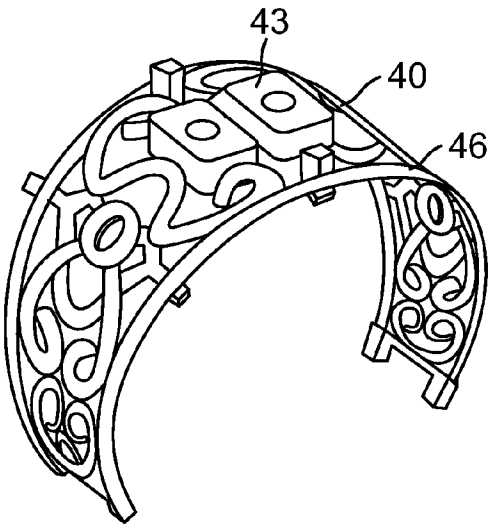
FIG. 15C is a perspective view of the core bottom welded to the J-back with the core bottom exposed including the transverse channel also fully exposed for insertion of a portion of the push clip.
Figure 15A:
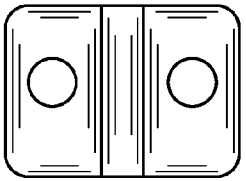
FIG. 15A is a top plan view of the J-back with the core bottom welded to the J-back.
Figure 15A:
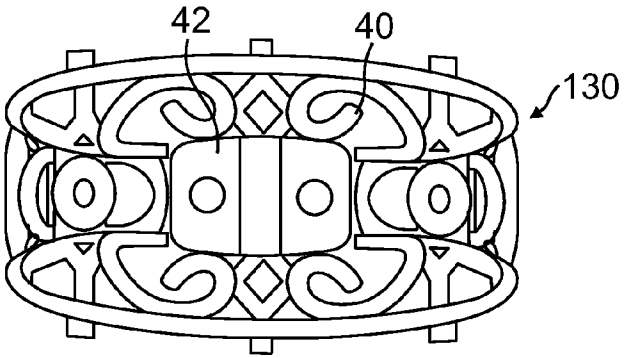
Figure 16A:
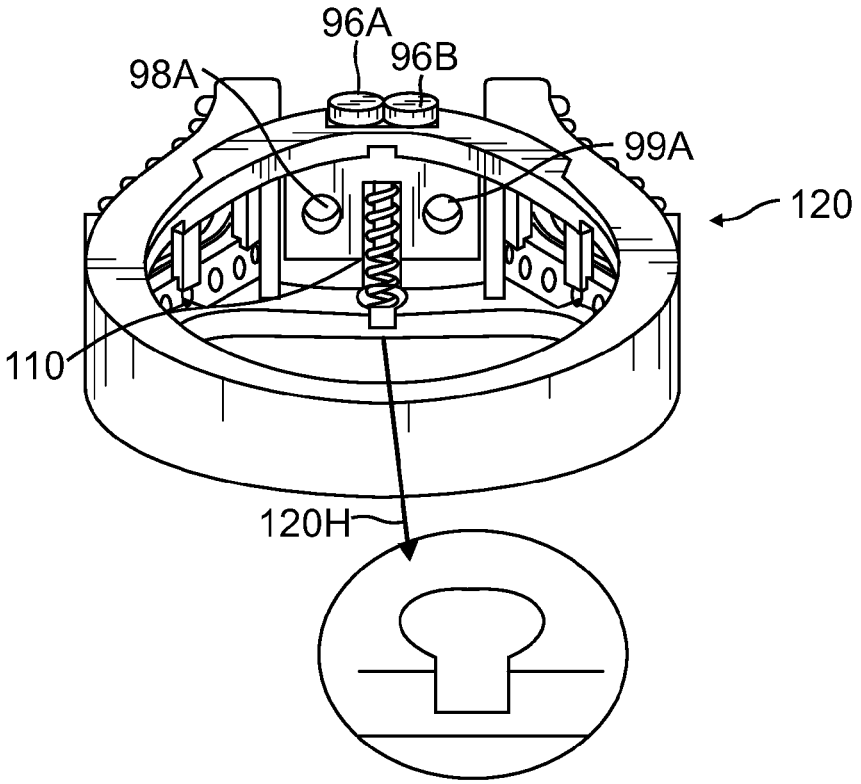
FIG. 16A is an interior perspective view showing the push clip inserted within the shank so that the press buttons extend through the push clip hole in the sidewall of the shank, the coil spring is retained on the center retaining rod of the push clip with a spring holder affixed to an exposed end of the retaining rod so that the rod and the coil spring are retained within the channel on the rear of the core top and the spring holder is pressed against an interior wall of the shank to provide a spring force from the spring.

As illustrated in FIGS. 15A and 15C, the core top 40 is welded to the J-back 130 so that the top surface 45 of the core top is welded to the J-back so that the core bottom 43 with the width-wise channel 46 is exposed. Referring to FIG. 16A the product assembly is as follows. The push clip 90 with the metal spring 120 wound around the center rod 110 has the spring 120 retained in place by a spring holder 120H (see FIG. 16A) and is placed on the rear surface 43 of the core top 40 (see FIG. 16B) so that the rod 110 and coil spring 120 are within channel 46 and push clip 90 is movable against the lower surface 43 of the core top 40 with the buttons 96A and 96B extending through the push clip hole 22 of the shank 10 with the spring holder 120H pressed against an interior wall 10I of the shank 10 of the jewelry item. The J-back 130 which is soldered or welded to the J-back receiving members 20 in interior wall 21 of the shank 10 so that the spring holder 120H is pressed against an interior wall 10I of shank 10 with the buttons 96A and 96B extending through the push clip opening 22 in the exterior sidewall 18 of jewelry shank. 10. The legs 98 and 99 of press plate 90 are moveable so that openings 98A and 42A are aligned and openings 99A and 44A are aligned is illustrated in FIG. 16A.

Figure 16B:
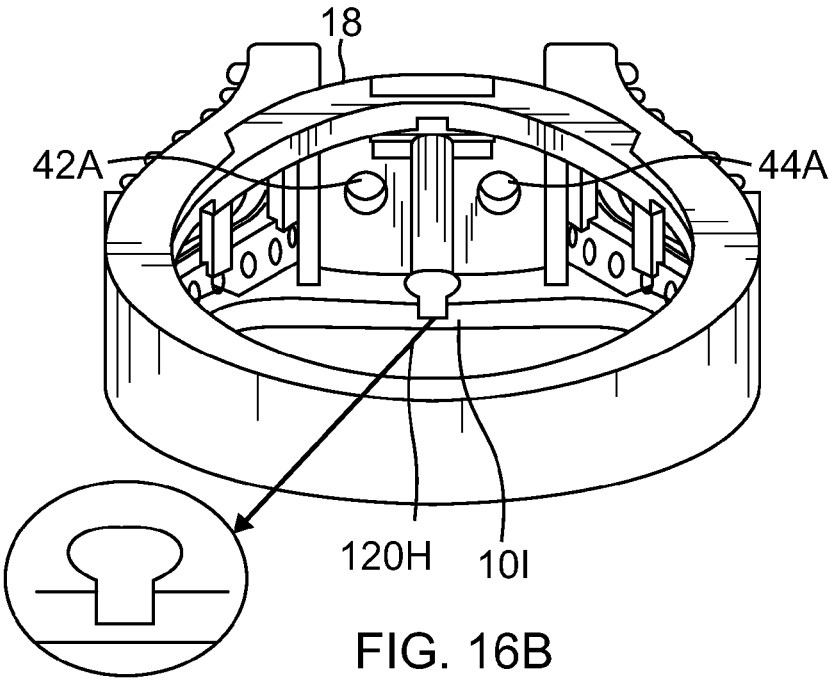
FIG. 16B shows the interior of the shank before the J-back is inserted so that the J-back covers the push clip while the push clip is still moveable between the interior of the shank and the J-back.
Figure 16C:
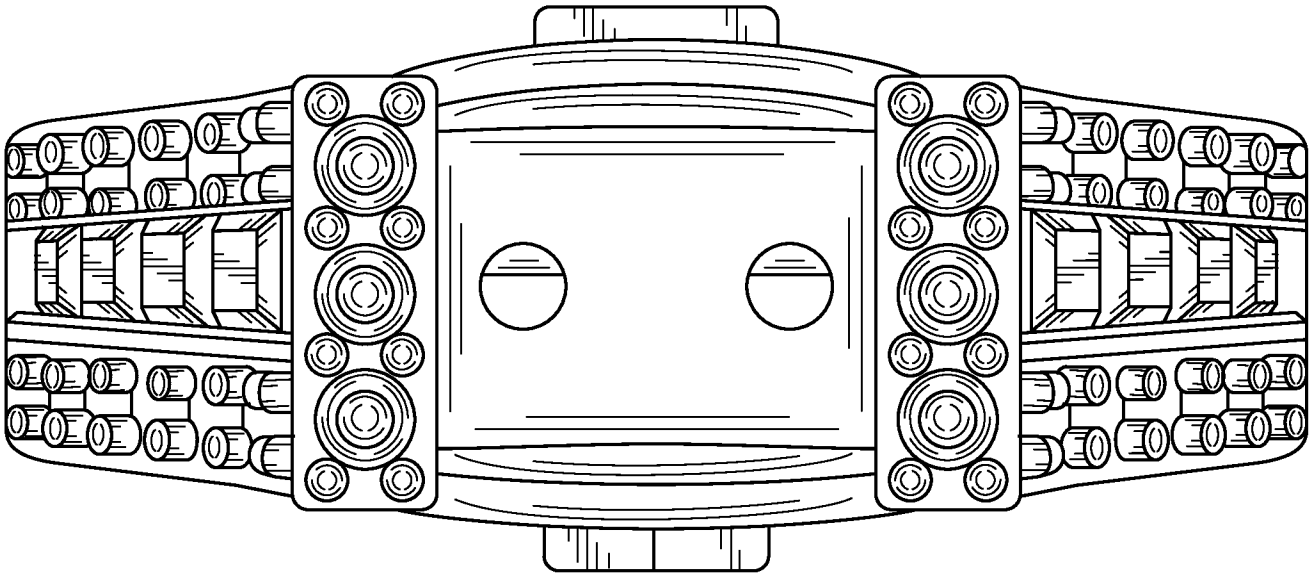
FIG. 16C shows the first and second legs of the push clip so that the legs of the push clip partially cover the aligned openings between the push clip and the core top, which aligned openings are 98A and 42A and 99A and 44A.

In operation, an underside of a selected ornamental jewelry head such as 30A is removably affixed to the upper surface of base 52 of locking part 50. The legs 62 and 62A have a proximal section 62P and 62AP affixed at spaced apart locations in the underside of the base 52. As illustrated in FIG. 16B, the first leg 98 and second leg 99 of push clip 90 are partially covering aligned holes 98A and 42A and 99A and 44A. As the legs 62 and 62A are inserted into the core top which is attached to the shank 10, slanted lower surfaces 62-PU and 62A-PU come in contact with legs 98 and 99 of the push clip 90, and a pushing force on the ornamental jewelry head 30A overcomes the force of coil spring 120. There is a clicking sound when the legs 62 and 62A are pushed through aligned openings 98A and 42A and 99A and 44A. The legs 98 and 99 from the push clip 90 create a force which overcomes the spring force from spring 120 so the leg openings 98A and 42A and 99A and 44A of the upper surface are affixed to the locking part 50. with a respective concave section 62-C with a portion of leg 98 retained in a concave section 62C of leg 60 and a portion of leg 99 retained in concave section 62A-C of leg 62A. With this affixation, the jewelry head is securely retained within the shank 10 because the force of the push clip sections 98 and 99 within the concave sections 62-C and 62A-C prevent the jewelry piece from falling out. To release the ornamental head 30A, the locking part is retained as follows. The pushbuttons 96A and 96B are pushed and the force of the pushbutton causes the legs 98 and 99 of the push clip 90 to overcome the spring force 120 and cause the holes 98A and 42A and 99A and 44A to be aligned so that the legs 62 and 62A can be pulled out of the shank. Therefore, a replacement head can easily be affixed within the shank in the same way. The shank of course is a form of a mounting base and depending upon the jewelry item such as a ring, a bracelet, a pendant etc., the mounting base will vary.

Therefore, through this first preferred embodiment, the ornamental jewelry is retained by having a pair of legs which are forced through openings in the interior of the shank which cause a push clip to be moved in a transverse direction so that the push clip can be inserted into concave sections of each leg to thereby retain the legs and which is the locking mechanism affixed to the jewelry head so that the jewelry head will not fall out. Ordinarily, a pulling force on a jewelry head will not be sufficient to remove the jewelry head and it is necessary to push the buttons 96A and 96B which will cause the press clip to move in a direction which overcomes the spring force of spring 120 so that the legs 96 and 96A of the locking clip 90 will be pushed away so that the openings within the shank are aligned as described above so that the replaceable heads with the locking part including the parallel feet can be pulled out. A click sound can be heard when the feet from the locking mechanism are inserted and retained within the jewelry shank and the only way to remove the removable head section is to press the button so that the feet from the push clip are moved in a direction to permit the holes to be opened and aligned so that the spaced apart feet from the locking mechanism can be removed.

The shank forms a mounting base for the ring and there can be different mounting bases, depending on the jewelry items, over which the heads can be inserted. While the rings are shown, it will be appreciated that the same mechanism can be utilized with any other jewelry mechanism such as a necklace, earrings, bracelets or pendants.

Insofar as the description above and the accompanying drawing disclose any additional subject matter that is not within the scope of the single claim below, the inventions are not dedicated to the public and the right to the one or more applications to claim such additional inventions is reserved.

Although a very narrow claim is presented herein, it should be recognized the scope of this invention is much broader than presented by the claim. It is intended that broader claims will be submitted in an application that claims the benefit of priority from this application.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adapted for use with an item of jewelry which includes a shank, the apparatus comprising:

a. a core top incorporated into a top of a body of a shank, the core top having a body with a top surface, a core bottom with a bottom surface and a central width-wise channel extending through an entire width of the core bottom and bottom surface, a first leg opening extending through the core top from the top surface through the bottom surface, a second leg opening extending through the core top from the top surface through the bottom surface, the first leg opening spaced apart from the second leg opening, the central width-wise channel located between the first leg opening and the second leg opening;

b. the shank having an interior sidewall with an interior J-back receiving member within the interior sidewall and an exterior sidewall with a transverse push clip opening extending into an entire transverse width of the shank below the bottom surface of the core bottom of the top surface;

c. the top surface of the core top is welded to the J-back receiving member to expose the central width-wise channel of the core bottom and bottom surface;

d. a push clip including a body with a transverse shaft terminating at its distal end in a first button and a second button, the push clip having a first leg with a first hole opening aligned with the first leg opening in the core top and a second leg with a second hole aligned with the second leg opening in the core top, the first leg and the second leg of the push clip are separated by an opening with a center rod extending parallel to the first leg and the second leg and affixed at its interior end to the body of the push clip, a coil spring wound over the center rod and retained by a spring holder;

e. the push clip is placed on the bottom surface of the core top so that the rod and coil spring are within the central width-wise channel of the core bottom and bottom surface and the push clip is moveable against the bottom surface of the core top with the first button and the second button of the push clip extending through the transverse push clip opening in the shank and the spring holder is pressed against an interior wall of the shank;

f. a base having an upper surface and a lower surface, a pair of spaced apart legs affixed to the bottom surface of the base, the spaced apart legs including a first leg with a proximal section affixed to the lower surface of the base, a distal section and a center concave section between the proximal section and the distal section, the distal section having a flat upper portion adjacent the concave section and the proximal section has a slanted lower surface adjacent the concave section, the spaced apart legs including a parallel spaced apart second leg with a proximal section affixed to the lower surface of the base, a distal section and a center concave section between the proximal section and the distal section, the distal section having a flat upper portion adjacent the concave section and the proximal section has a slanted lower surface adjacent the concave section, the first leg aligned with the first leg opening in the core top and the second leg aligned with the second leg opening in the core top, the upper surface of the base removably affixed to an underside of an ornamental jewelry head; and g. the base with the ornamental jewelry head is retained by a downward force causing the first leg to pass through the first leg opening in the core top and cause the push clip to move in a transverse direction and pass through the first hole in the push clip and simultaneously the second leg to pass through the second leg opening in the core top and cause the push clip to move in a transverse direction and pass through the second hole in the push clip and a spring force of the coil spring causes the body of the push clip to be inserted into each respective concave section of the respective first leg and second leg to retain the ornamental jewelry head and base onto the shank, and a transverse force on the first pushbutton and the second pushbutton overcome the spring force and respectively cause the first hole in the push clip to be aligned with the first leg opening in the core top and the second hole in the push clip to be aligned with the second leg opening in the core top so that the first and second leg can be removed from the shank.

2. An apparatus adapted for use with an item of jewelry which includes a shank, the apparatus comprising:

a. a core top incorporated into a top of a body of a shank, the core top having a body with a top surface, a core bottom with a bottom surface and a central width-wise channel extending through an entire width of the core bottom and bottom surface, a first leg opening extending through the core top from the top surface through the bottom surface, a second leg opening extending through the core top from the top surface through the bottom surface, the first leg opening spaced apart from the second leg opening, the central width-wise channel located between the first leg opening and the second leg opening;

b. the shank having an exterior sidewall with a transverse push clip opening extending into an entire transverse width of the shank below the bottom surface of the core bottom of the core top;

c. a push clip including a body with a transverse shaft terminating at its distal end in a pushbutton, the push clip having a first leg with a first leg opening aligned with the first leg opening in the core top and a second leg with a second hole aligned with the second leg opening in the core top, the first leg and the second leg of the push clip are separated by an opening with a center rod extending parallel to the first leg and the second leg and affixed at its interior end to the body of the push clip, a coil spring wound over the center rod and retained by a spring holder;

d. the push clip is placed on the bottom surface of the core top so that the rod and coil spring are within the central width-wise channel of the core bottom and the bottom surface and the push clip is moveable against the bottom surface of the core top with the pushbutton of the push clip extending through the transverse push clip opening in the shank and the spring holder is pressed against an interior wall of the shank;

e. a base having an upper surface and a lower surface, a pair of spaced apart legs affixed to the bottom surface of the base, the spaced apart legs including a first leg with a proximal section affixed to the lower surface of the base, a distal section and a center concave section between the proximal section and the distal section, the spaced apart legs including a parallel spaced apart second leg with a proximal section affixed to the lower surface of the base, a distal section and a center concave section between the proximal section and the distal section, the first leg aligned with the first leg opening in the core top and the second leg aligned with the second leg opening in the core top, the upper surface of the base affixed to an underside of a jewelry head; and f. the base with the jewelry head is retained by a downward force causing the first leg to pass through the first leg opening in the core top and cause the push clip to move in a transverse direction and pass through the first hole in the push clip and simultaneously the second leg to pass through the second leg opening in the core top and cause the push clip to move in a transverse direction and pass through the second hole in the push clip and a spring force of the coil spring causes the body of the push clip to be inserted into each respective concave section of the respective first leg and second leg to retain the jewelry head and base onto the shank, and a transverse force on the pushbutton overcomes the spring force and respectively cause the first hole in the push clip to be aligned with the first leg opening in the core top and the second hole in the push clip to be aligned with the second leg opening in the core top so that the first and second leg can be removed from the shank.

* * * * *